US008764613B1

(12) United States Patent
Barnes

(10) Patent No.: US 8,764,613 B1
(45) Date of Patent: Jul. 1, 2014

(54) HAND THERAPY EXERCISE TOOLS, AND KIT OF COMPONENTS

(75) Inventor: Carolyn Sarah Barnes, Scottsdale, AZ (US)

(73) Assignee: Elliott Goldberg, Scarsdale, NY (US)

( * ) Notice: Subject to any disclaimer, the term of this patent is extended or adjusted under 35 U.S.C. 154(b) by 367 days.

(21) Appl. No.: 13/346,414

(22) Filed: Jan. 9, 2012

Related U.S. Application Data

(63) Continuation-in-part of application No. 11/811,840, filed on Jun. 12, 2007, now Pat. No. 8,096,924.

(51) Int. Cl.
*A63B 23/14* (2006.01)
*A63B 23/16* (2006.01)

(52) U.S. Cl.
USPC ..... 482/44

(58) Field of Classification Search
USPC ..... 482/44–50, 92, 148, 910; 601/23, 33, 601/40
See application file for complete search history.

(56) References Cited

U.S. PATENT DOCUMENTS

| | | | | | |
|---|---|---|---|---|---|
| 2,908,246 | A | * | 10/1959 | Alexander et al. | 118/268 |
| 4,569,815 | A | * | 2/1986 | Rentz et al. | 264/323 |
| 5,427,528 | A | * | 6/1995 | Anderson et al. | 434/83 |
| 5,446,075 | A | * | 8/1995 | Gibbon | 523/137 |
| 5,472,994 | A | * | 12/1995 | Micallef et al. | 523/137 |
| 5,693,689 | A | * | 12/1997 | Gibbon | 523/137 |
| 5,755,648 | A | * | 5/1998 | Kildani | 482/121 |
| 5,794,627 | A | | 8/1998 | Frantz et al. | |
| 5,820,522 | A | | 10/1998 | Smallwood et al. | |
| 5,890,999 | A | * | 4/1999 | Kildani | 482/49 |
| 6,391,941 | B1 | | 5/2002 | Williams | |
| 6,454,681 | B1 | * | 9/2002 | Brassil et al. | 482/49 |
| 7,618,349 | B1 | * | 11/2009 | Muderick | 482/44 |
| 7,666,942 | B2 | * | 2/2010 | Minuto et al. | 524/858 |
| 2004/0072653 | A1 | * | 4/2004 | Minuto et al. | 482/49 |
| 2004/0082886 | A1 | | 4/2004 | Timpson | |
| 2004/0200748 | A1 | * | 10/2004 | Klassen et al. | 206/368 |
| 2005/0250620 | A1 | * | 11/2005 | Minuto et al. | 482/49 |
| 2006/0030463 | A1 | * | 2/2006 | Maloy et al. | 482/126 |
| 2008/0276396 | A1 | * | 11/2008 | Lucero | 15/144.2 |
| 2008/0312564 | A1 | * | 12/2008 | Mittelsteadt | 601/40 |
| 2009/0111662 | A1 | | 4/2009 | Wagner et al. | |
| 2010/0267523 | A1 | | 10/2010 | Wilkinson et al. | |
| 2011/0036746 | A1 | * | 2/2011 | Bear | 206/572 |
| 2011/0287900 | A1 | * | 11/2011 | Mittelsteadt | 482/44 |

OTHER PUBLICATIONS http://web.archive.org/web/20110718193751/http:www.hasbro.com/playdoh/.*

* cited by examiner

*Primary Examiner* — Oren Ginsberg
(74) *Attorney, Agent, or Firm* — Weiner & Burt, P.C.; Irving M. Weiner; Pamela S. Burt

(57) ABSTRACT

A kit of components of a multi-functional group of hand/forearm exercise tools wherein each tool permits the user to strengthen one or more muscles associated with the hand/forearm of the user, and/or to increase radial and ulnar deviation and forearm pronation and supination, or permits the user to mimic a functional task, such as turning a door knob, opening a bottle cap, inserting and turning a key, turning and tightening a nut, and turning and tightening a bolt.

20 Claims, 14 Drawing Sheets

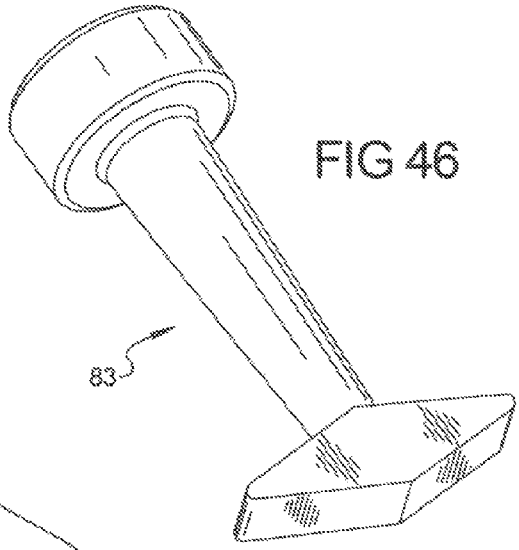
FIG 46
FIG 47
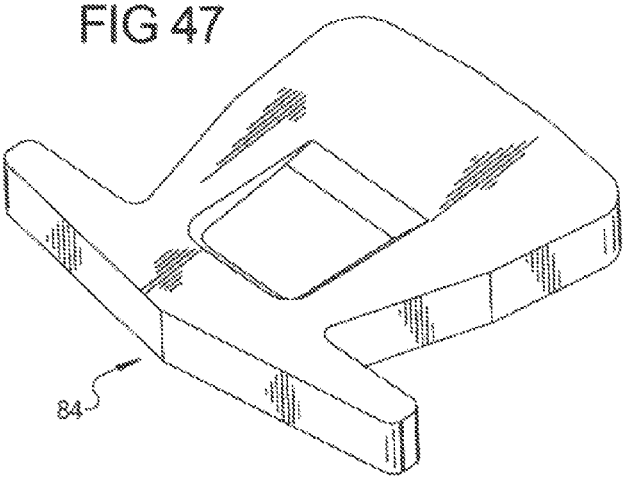
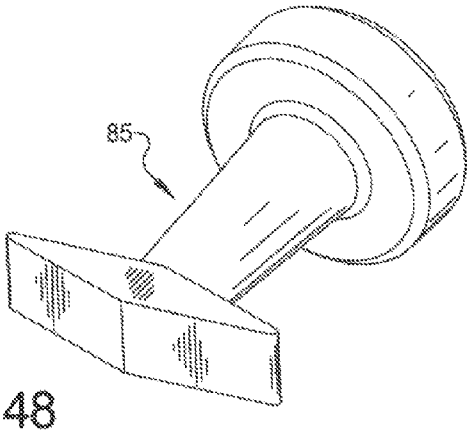
FIG 48

HAND THERAPY EXERCISE TOOLS, AND KIT OF COMPONENTS

CROSS-REFERENCE TO RELATED APPLICATIONS

The present application is a continuation-in-part of U.S. patent application Ser. No. 11/811,840 filed Jun. 12, 2007, now U.S. Pat. No. 8,096,924.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to a novel kit of components and hand therapy exercise tools, and methods of constructing and utilizing same.

More particularly, the present invention relates to the aforementioned kit of components and tools, and methods used in conjunction with therapeutic putty of various resistances.

Heretofore, a patient may arrive at a hand therapy clinic status-post, for example, a distal radius fracture. Such a patient may have been splinted for six weeks or so. Typically, such a patient has limitations of radial/ulnar deviation, fine motor skills, and functional deficits. Before the advent of the present invention, the tools and techniques available to patient and therapist were limited and not very effective.

The prior, but not necessarily relevant, art is exemplified by:

Smallwood et al. U.S. Pat. No. 5,820,522;

Williams U.S. Pat. No. 6,391,941; and

Minuto et al. US Patent Application Publication US2004/0072653.

The present invention solves the aforementioned problems and other problems.

It is a desideratum of the present invention to avoid the animadversions of conventional hand therapy exercise tools and techniques, and to provides novel kits of components, hand/forearm therapy exercise tool, and sets of various shaped hand/forearm therapy exercise tool to perform a hand exercise/therapy methods.

SUMMARY OF THE INVENTION

The present invention provides a kit of components, comprising: at least one exercise tool for use with a therapeutic exercise putty; at least one container of graded resistance therapeutic exercise putty; and a carrying case for said at least one exercise tool and said at least one container of graded resistance therapeutic exercise putty.

The present invention also provides a hand/forearm therapy exercise tool, comprising, in combination: a tool member having a first predetermined portion having a first predetermined shape and configuration for insertion into a therapeutic putty; said tool member having a second predetermined portion having a second predetermined shape and configuration enabling a patient to manipulate said tool member to cause said tool to move in a predetermined trajectory within and relative to said putty; said first predetermined shape and configuration of said first portion providing a predetermined resistance to said movement of said tool within and relative to said putty; and said tool member has a shape selected from a group consisting of a bolt, a nut, a bottle cap, a key, a door knob, a peg, a digit extension loop, a pro/sup wheel, a crank, a plank, a "T" bar, an "L" bar, a finger extender tool, an intrinsic adduction tool, a zipper pull tool, an utensil tool, an intrinsic turn tool, a desensitizer tool, a razor tool, a toothbrush tool, a saw handle tool, a screwdriver tool, a ball tool, a handle tool, a cross-handle turn tool, a cap turn tool, a key turn tool, a knob turn tool, an"L" bar tool, and a peg turn tool.

The present invention further provides a set of various shaped hand/forearm therapy exercise tools for use with therapeutic putty, comprising: a plurality of various shaped hand/forearm therapy exercise tools; each said tool having an associated first predetermined portion having a first predetermined shape and configuration for insertion into therapeutic putty; each said tool having an associated second predetermined portion having a second predetermined shape and configuration enabling a patient to manipulate the tool to cause the tool to move in a predetermined trajectory within and relative to the putty; said first predetermined shape and configuration of said first portion providing a predetermined resistance to said movement of the tool within and relative to the putty; and said plurality of exercise tools have a shape selected from a group consisting of a bolt, a nut, a bottle cap, a key, a door knob, a peg, a digit extension loop, a pro/sup wheel, a crank, a plank, a "T" bar, an "L" bar, a finger extender tool, an intrinsic adduction tool, a zipper pull tool, an utensil tool, an intrinsic turn tool, a desensitizer tool, a razor tool, a toothbrush tool, a saw handle tool, a screwdriver tool, a ball tool, a handle tool, a cross-handle turn tool, a cap turn tool, a key turn tool, a knob turn tool, an"L" bar tool, and a peg turn tool.

An object of the invention is to enable a user of the aforesaid kit of components, the aforesaid hand/forearm therapy exercise tool, and/or the aforesaid a set of various shaped hand/forearm therapy exercise tool to perform a hand therapy method, comprising the steps of: providing a first therapeutic putty having a first predetermined resistance; providing a first predetermined hand therapy exercise tool; inserting a first predetermined portion of said tool into first putty; permitting a patient to cause said tool to move a first predetermined trajectory within and relative to said first putty until said patient can do so with ease; removing said tool from said first putty; providing a second therapeutic putty having a second predetermined resistance which is greater than said first predetermined resistance; inserting said first predetermined portion of said tool into said second putty; and permitting the patient to cause said tool to move second predetermined trajectory within and relative to said second putty until said patient can do so with ease.

Another object of the present invention to provide functional hand exercise equipment. Another object of the invention is to provide a set of various shaped hand therapy exercise tools which are used with graded resistant putty Other objects, advantages, and features of the present invention will become apparent to those persons skilled in this particular area of technology and to other persons after having been exposed to the present patent application when read in conjunction with the accompanying patent drawings.

BRIEF DESCRIPTION OF THE DRAWINGS

FIG. 46 is a perspective view of a cap turn tool.

FIG. 47 is a perspective view of a second key turn tool.

FIG. 48 is a perspective view of a second knob turn tool.

DETAILED DESCRIPTION OF THE INVENTION

The invention provides novel various-shaped tools, a kit of components, and methods of using same for exercise and/or for treating hand/forearm/finger conditions, such as, for example, tendon lacerations, finger/wrist fractures, finger amputations, carpel tunnel syndrome, tendonitis, arthritis, crush injuries, RSD, etc.

The tools are specifically designed to be used with graded-resistant therapeutic putty 14. The putty 14 provides functional simulation with graded resistance during a therapeutic exercise program. The putty 14 comes in various thicknesses which provide various resistances to moving a first predetermined portion 15-41 of the tools therein and/or therethrough.

The tools provide the patient with functional simulation and graded resistance for various tasks, e.g., opening a door (knob turn), opening a bottle of water (smaller knob turn), work limitations with tightening a bolt, limitations with turning a key, etc.

In describing the tools and the various exercises with which they can be used, reference is made hereinbelow to the accompanying drawings and photos together with the text juxtaposed to such photos, which text is incorporated in this detailed description by reference thereto to best facilitate understanding the tools and their uses.

Figure 1:
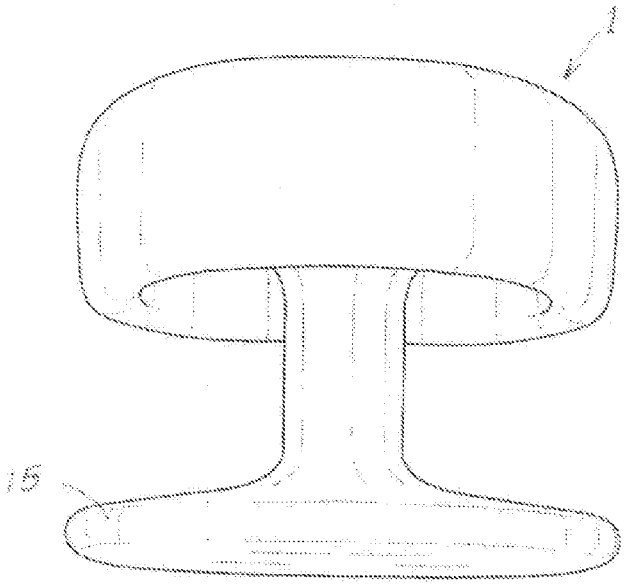
FIG. 1 is a perspective view of a knob turn tool.
Figure 2:
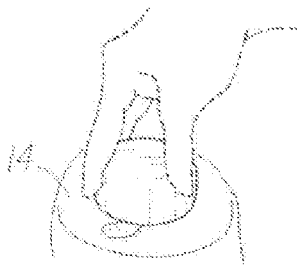
FIG. 2 is shows the FIG. 1 tool being used with fingertips.
Figure 3:
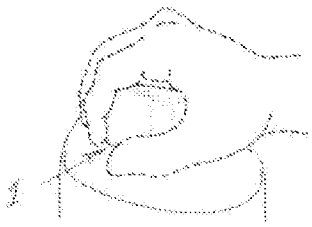
FIG. 3 is shows the FIG. 1 tool being used with the basic grip.

With reference to FIGS. 1-3, there is shown a knob turn tool 1 having a first predetermined portion 15 having a predetermined shape and configuration for insertion into the therapeutic putty 14. The tool 1 can be used to improve various conditions of the hand/forearm as illustrated with reference to FIGS. 1-3. The tool 1 may be made out of a hard plastic. The base 15 is narrowed at the end to aid with moving through the resistant putty 14. The knob shape and size of tool 1 are formed to simulate a basic jar top, lid and doorknob size. Tool 1 may be modified by adding a soft grip surface to increase ease with grasp. Resistance may be graded in by increasing the thickness of putty 14 and by adjusting the speed in which each exercise is performed. The knob turn piece 1 is inserted into the putty 14 by placing it on top of a mound of putty and gently pushing down to insert the base 15 into the resistance. The top portion is then used as a functional exercise to rotate, simulating the activity. The object requires the user to reinsert the object into the putty at various times throughout the exercise to continue having resistance. The exercise time, resistance, and form of exercise is determined by the treating therapist.

Figure 4:
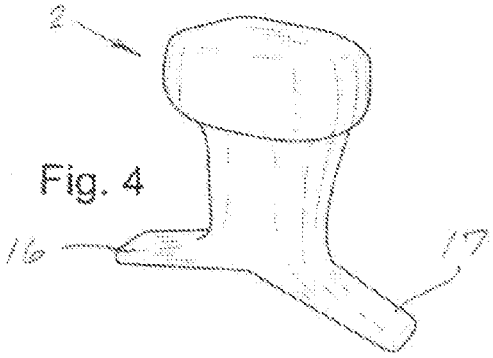
FIG. 4 shows a small knob turn tool.
Figure 5:
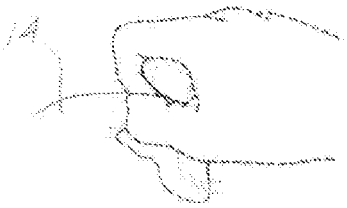
FIG. 5 shows the FIG. 4 tool being used with the basic grip.
Figure 6:
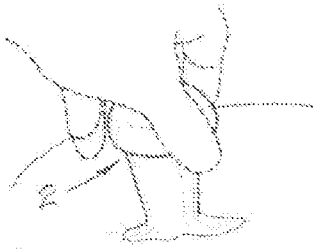
FIG. 6 shows the FIG. 4 tool being used with fingertips.

With reference to FIGS. 4-6, there is shown a small knob turn tool 2 having first predetermined portions 16 and 17 having a predetermined shape and configuration for insertion into the therapeutic putty 14. The tool 2 can be used to improve various conditions of the hand/forearm as illustrated with reference to FIGS. 4-6. Tool 2 may made out of a strong plastic. The small knob shape and size of tool 2 are formed to simulate a basic lid to a bottle, including variations such as a water bottle, a soda bottle, a beer bottle, and a pipe top. Tool 2 may be modified by adding a soft grip surface to increase ease with the grip. Resistance may be graded in by increasing the thickness of putty 14 and by adjusting the speed in which each exercise is performed. The treatment protocol may be determined by the treating therapist. The small knob turn piece 2 is inserted into the putty 14 by placing it on top of a mound of putty and gently pushing down to insert the bases 16 and 17 into the resistance putty 14. The top portion is then used as a functional exercise to rotate/simulate an activity. The object is to require the patient to reinsert tool 2 into the putty at various times throughout the exercise to continue having resistance.

Figure 7:
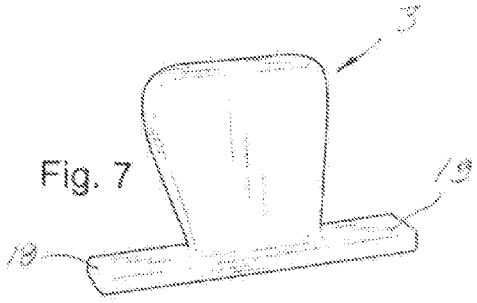
FIG. 7 shows a key turn tool.
Figure 8:
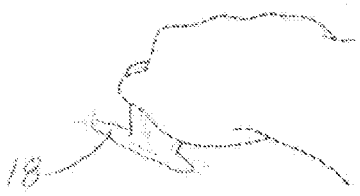
FIG. 8 shows the basic key turn exercise.
Figure 9:
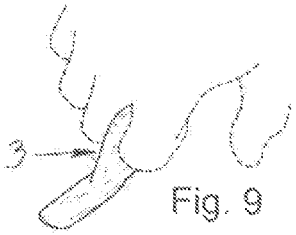
FIG. 9 shows the FIG. 7 tool being used with the intrinsic function between digits.

With reference to FIGS. 7-9, there is shown a key turn tool 3 having first predetermined portions 18 and 19 having a predetermined shape and configuration for insertion into the therapeutic putty 14. The tool 3 can be used to improve various conditions of the hand/forearm as illustrated with reference to FIGS. 7-9. Tool 3 may be made out of a hard plastic. The bases 18 and 19 are tapered at the ends to ease with moving through the resistant putty 14. The top of tool 3 is shaped to simulate a key-type object. Resistance may be graded in by increasing the thickness of putty 14 and by adjusting the speed in which each exercise is performed. The key turn piece 3 is inserted into the putty 14 by placing it on top of a mound of putty and gently pushing down to insert the bases 18 and 19 into the resistance putty 14. The top portion is then used to simulate functional exercises by rotating and/or pulling out of putty 14. The object is to require the patient to reinsert the tool 3 into the putty at various times throughout the exercise to continue having resistance. The exercise time, resistance, and form of exercise may be determined by the treating therapist.

Figure 10:
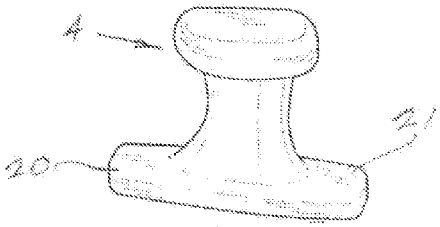
FIG. 10 shows a bolt turn tool.
Figure 11:
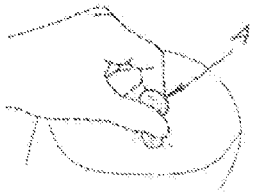
FIG. 11 shows the FIG. 10 tool being used for fine motor skills.
Figure 12:
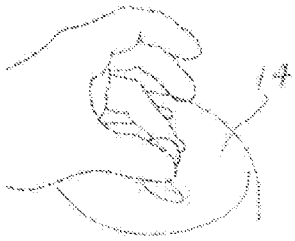
FIG. 12 shows the FIG. 10 tool being used to improve fine motor coordination of individual digits.

With reference to FIGS. 10-12, there is shown a bolt turn tool 4 having first predetermined portions 20 and 21 having a predetermined shape and configuration for insertion into the therapeutic putty 14. The tool 4 can be used to improve various conditions of the hand/forearm as illustrated with reference to FIGS. 10-12. Tool 4 may be made out of hard plastic. The bases 20 and 21 are narrowed at their ends to ease with moving the tool 4 through the resistant putty 14. The knob shape and size of tool 4 are formed to simulate tightening a bolt. This can also aid in increasing and strengthening fine motor skills. The base shape and size are smaller to decrease the required force to push the tool 4 through the resistant putty 14. The bolt turn piece 4 is inserted into the putty 14 by placing it on top of a mound of putty and gently pushing down to insert the bases 20 and 21 into the resistance putty 14. The top portion of tool 4 is then used for functional exercises with rotating tool 4 through the resistance putty 14, simulating the activity. The object is to requires the user to reinsert the tool 4 into the putty and rotate it at various times throughout the exercise to continue having resistance. The exercise time, resistance of putty, and form of exercise may be determined by the treating therapist.

Figure 13:
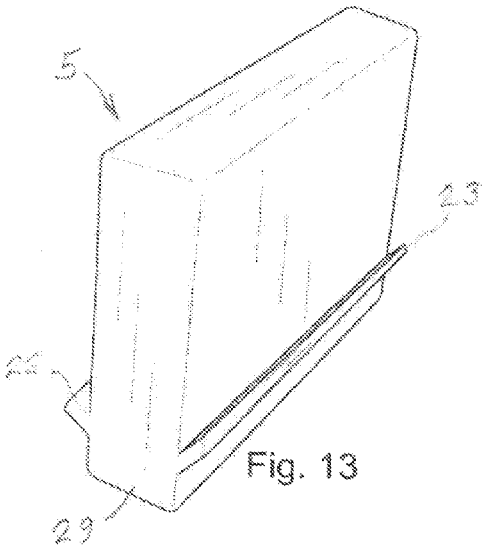
FIG. 13 shows a plank tool.
Figure 14:
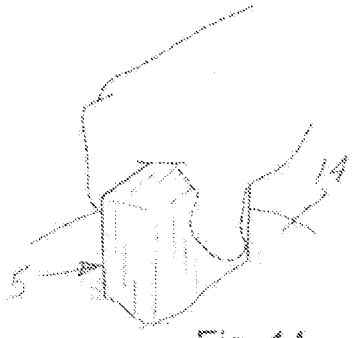
FIG. 14 shows the FIG. 13 tool being used in the intrinsic plus position.

With reference to FIGS. 13 and 14, there is shown a plank tool 5 having first predetermined portions 22, 23 and 29 having a predetermined shape and configuration for insertion into the therapeutic putty 14. The tool 5 can be used to improve various conditions of the hand/forearm as illustrated with reference to FIGS. 13 and 14. Tool 5 may be made out of a hard plastic. Resistance may be graded in by increasing the thickness of putty 14 and by adjusting speed in which each exercise is performed. The purpose of piece 5 is to simulate an intrinsic plus position of the hand. This produces a resistive exercise focusing on the intrinsic muscles of the hand. This can be used to simulate pulling an object out of a resistive substance, picking up an oblong object, rotating an object, and various activities performed throughout the day. Hand therapists may use this exercise to strengthen median and ulnar innervated muscles. The resistance may require the patient to replace the tool 5 in the putty 14 to continue having a resistant exercise. The tool 5 is placed into the putty by pushing/pulling/and/or rotating one end into the putty. The exercise time, resistance, and form of exercise is determined by the treating therapist.

Figure 15:
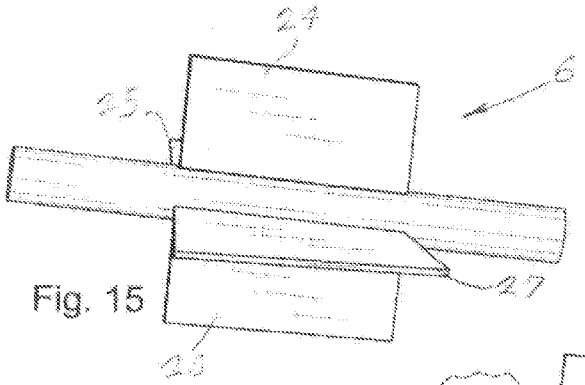
FIG. 15 shows a "T" bar tool.
Figure 16:
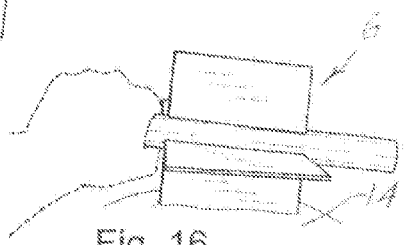
FIG. 16 shows the FIG. 15 tool being used.

With reference to FIGS. 15 and 16, there is shown a "T" bar tool 6 having first predetermined portions 24-27 having a predetermined shape and configuration for insertion into the therapeutic putty 14. The tool 6 can be used to improve various conditions of the hand/forearm as illustrated with reference to FIGS. 15 and 16. The tool 6 may be made out of a hard plastic. The resistance may be graded in by increasing the thickness of putty 14 and by adjusting the speed in which each exercise is performed. Tool 6 is used by gripping one or both ends of the circular bar and placing the extended planks 24-27 into the putty 14. The bar is then rotated forward, backward, or from side to side to create a resistant force. The exercise time, resistance, and form of exercise is determined by the treating therapist.

Figure 17:
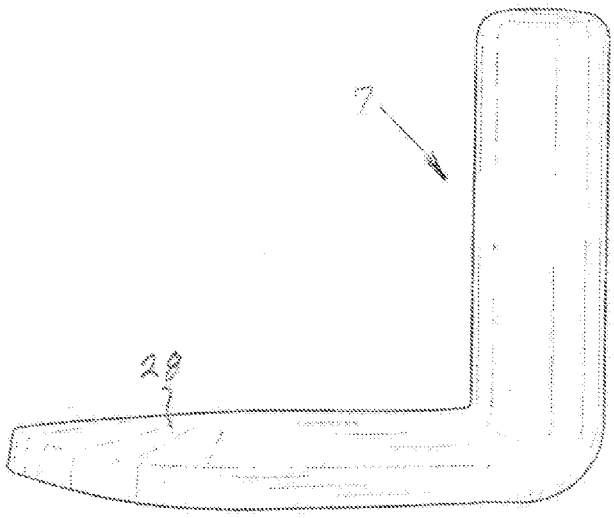
FIG. 17 shows an "L" bar tool.
Figure 18:
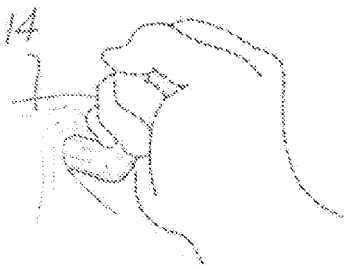
FIG. 18 shows the FIG. 17 tool being used for radial deviation.
Figure 19:
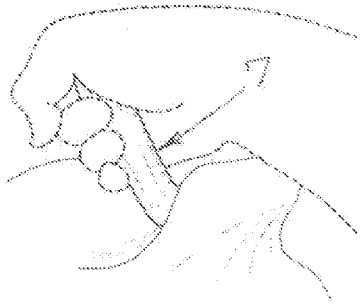
FIG. 19 shows the FIG. 17 tool being used for ulnar deviation.
Figure 20:
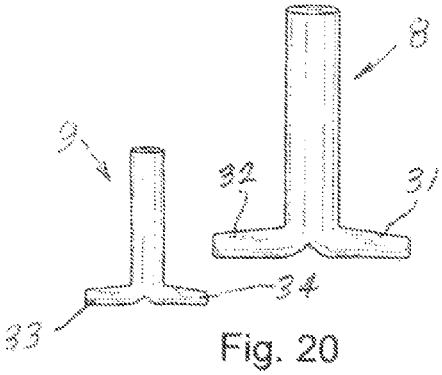
FIG. 20 shows peg tools.
Figure 21:
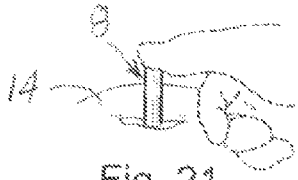
FIG. 21 shows a FIG. 20 tool being pushed down.

With reference to FIGS. 17-19, there is shown an "L" bar tool 7 having a first predetermined portion 28 having a predetermined shape and configuration for insertion into the therapeutic putty 14. The tool 7 can be used to improve various conditions of the hand/forearm as illustrated with reference to FIGS. 17-19. Tool 7 may be made out of a hard plastic. Both ends are tapered to ease with the torque required to move through the resistance putty 14. The "L" form is to allow for exercises to be performed to increase radial and ulnar deviation and forearm pronation and supination. Resistance may be graded in by increasing the thickness of putty 14 and/or by adjusting the speed in which each exercise is performed. The "L" bar 7 is placed into the putty 14 by inserting one end into the putty. The remaining end is used as a lever to pull the inserted end out of the putty. The object is to require the patient to reinsert the tool 7 into the putty at various times throughout the exercise to continue having resistance. The exercise time, resistance, and the form of exercise is determined by the treating therapist.

With reference to FIGS. 20, 21, 30 and 31, there are shown peg tools 8-10 having first predetermined portions 31-34, 40 and 41 having a predetermined shape and configuration for insertion into the therapeutic putty 14. The tools 8-10 can be used to improve various conditions of the hand/forearm as illustrated with reference to FIGS. 20, 21, 30 and 31. Tools 8-10 may made out of a hard plastic. The pegs 8-10 (e.g., a set of ten) are designed in various sizes. The intent is to provide various widths to push/pull pegs 8-10 into putty 14, and also provide turning. Each peg 8-10 has a base 31-34, 40 and 41 which is lengthened and tapered to provide appropriate resistance. Resistance may be graded in by increasing the thickness of the putty 14 and by adjusting the speed at which each exercise is performed. The dimensions of pegs 8-10 may vary to simulate various functional uses. The initial process includes pushing the pegs into the putty to insert the base. The pole of the peg is then used to rotate, pull out, or push further in. The object is to require the patient to insert, rotate, and/or re-insert the peg into the putty at various times throughout the exercise to continue having the desired resistance. The exercise time, resistance, and form of each exercise is determined by the treating therapist.

Figure 22:
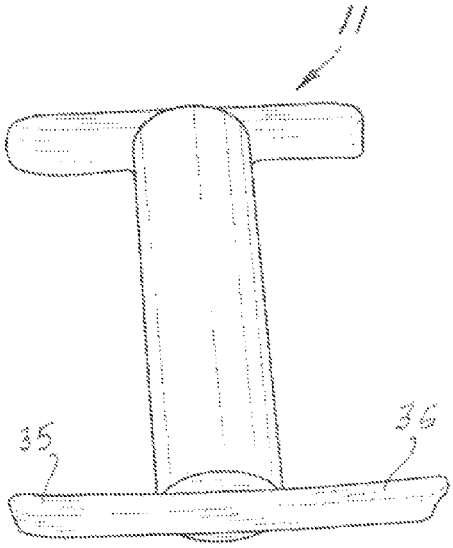
FIG. 22 shows a crank turn tool.
Figure 23:
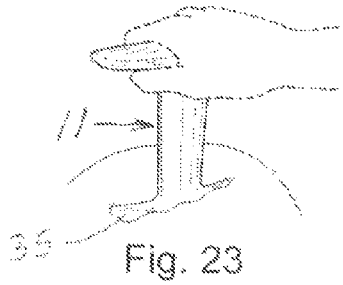
FIG. 23 shows the FIG. 22 tool being used for a top crank turn.
Figure 24:
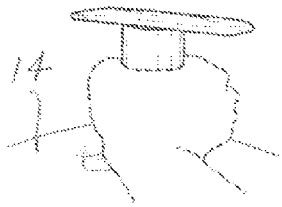
FIG. 24 shows the FIG. 22 tool being used for a shaft crank turn.

With reference to FIGS. 22-24, there is shown a crank turn tool 11 having first predetermined portions 35 and 36 having a predetermined shape and configuration for insertion into the therapeutic putty 14. The tool 11 can be used to improve various conditions of the hand/forearm as illustrated with reference to FIGS. 22-24. Tool 11 may be made of a hard plastic. The double "T" form is to simulate turning a bar. The shaft of the crank turn 11 is rounded to simulate a pipe. Resistance may be graded in by increasing thickness of putty 14 and by adjusting speed at which each exercise is performed. The crank turn 11 can be used in various ways, e.g., to insert one base into the putty and simulate a turning/tightening action; to insert one base into the putty and grip the shaft to produce a rotating action; to hold onto the shaft and place one base into the putty and produce a rotating action; etc. The object is to require the patient to insert, rotate, and/or re-insert the tool 11 into the putty at various times throughout the exercise to continue having resistance. The exercise time, resistance, and form of each exercise is determined by the treating therapist.

Figure 25:
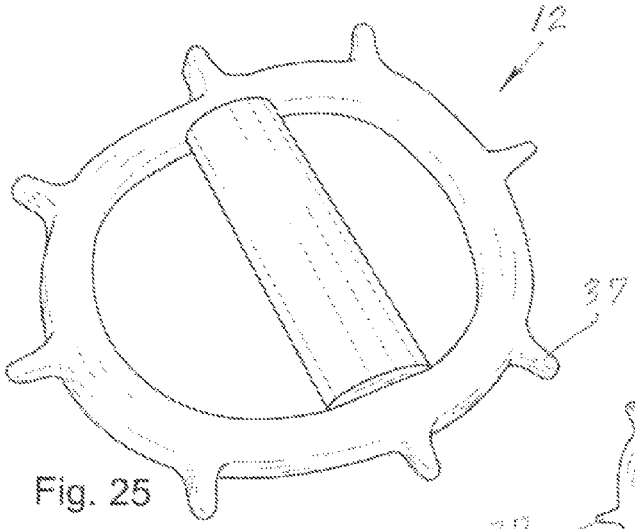
FIG. 25 shows a pro/sup wheel tool.
Figure 26:
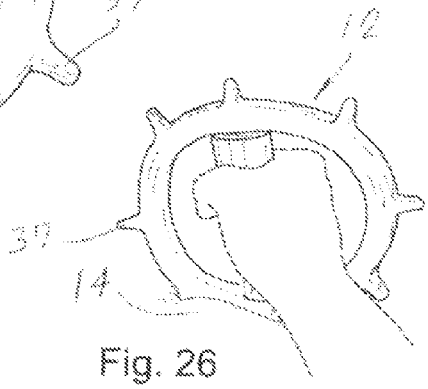
FIG. 26 shows the FIG. 25 tool being used for forearm pronation.

With reference to FIGS. 25 and 26, there is shown a pro/sup wheel tool 12 having first predetermined portions 37 having a predetermined shape and configuration for insertion into the therapeutic putty 14. The tool 12 can be used to improve various conditions of the hand/forearm as illustrated with reference to FIGS. 25 and 26. Tool 12 may made of a hard plastic, and formed as an oval to increase the time of resistance during rotation. The center bar of tool 12 is a round mass to simulate a gripping activity. Resistance may be graded in by increasing thickness of putty 14 and by adjusting the speed in which each exercise is performed. The spikes 37 of the tool 12 are inserted into the putty to provide resistance. The forearm is then rotated to produce a supination and/or pronation activity. This activity can simulate opening of a door, tightening of an object, and many other functional activities. The purpose is to require the patient to insert, rotate, and/or re-insert tool 12 into the putty 14 at various times throughout each exercise to continue having resistance. The exercise time, resistance, and form of each exercise is determined by the treating therapist.

Figure 27:
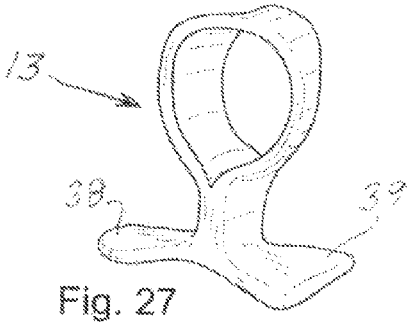
FIG. 27 shows a digit extension loop tool.
Figure 28:
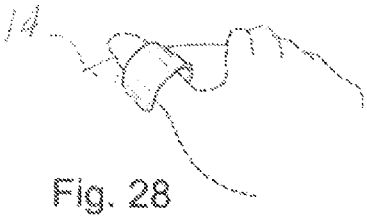
FIG. 28 shows the FIG. 27 tool being used for extensor pollicis longus isolation.
Figure 29:
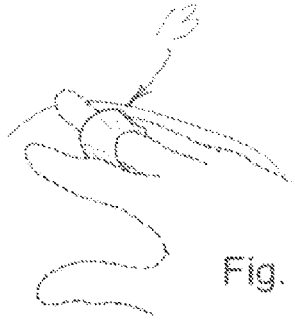
FIG. 29 shows the FIG. 27 tool being used for digit extension.
Figure 30:
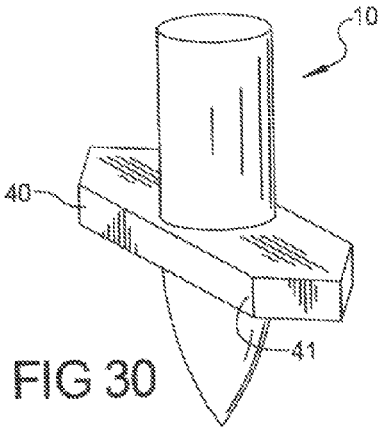
FIGS. 30 and 31 show a different embodiment of the FIG. 20 tools.
Figure 31:
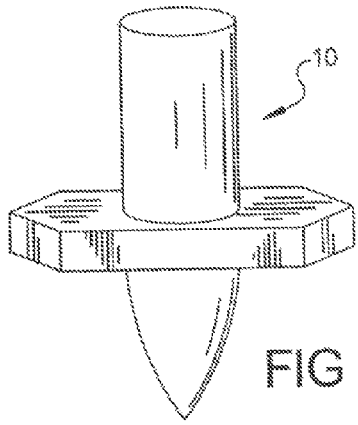

With reference to FIGS. 27-29, there is shown a digit extension loop tool 13 including first predetermined portions 38 and 39 having a predetermined shape and configuration for insertion into the therapeutic putty 14. The tool 13 can be used to improve various conditions of the digits/hand as illustrated with reference to FIGS. 27-29. Tool 13 may be made out of a hard plastic. The shape of tool 13 is formed to allow a digit to be inserted through a loop to provide a resistance with digit extension. The base 38 and 39 is in a "T" formation to grip into the putty 14 to provide resistance. The width of the loop is wide to accommodate to various sizes of digits. Resistance may be graded in by increasing the thickness of putty 14 and/or by adjusting the speed at which each exercise is performed. The base of tool 13 is pushed down into the putty to provide a resistance. The digit of choice is placed through the loop of tool 13. The digit is then extended to produce a movement of extension. The purpose is to require the patient or exerciser to insert and re-insert tool 13 into the putty at various times throughout the exercise to continue having resistance. The exercise time, resistance, and form of exercise is determined by the treating therapist.

Figure 32:
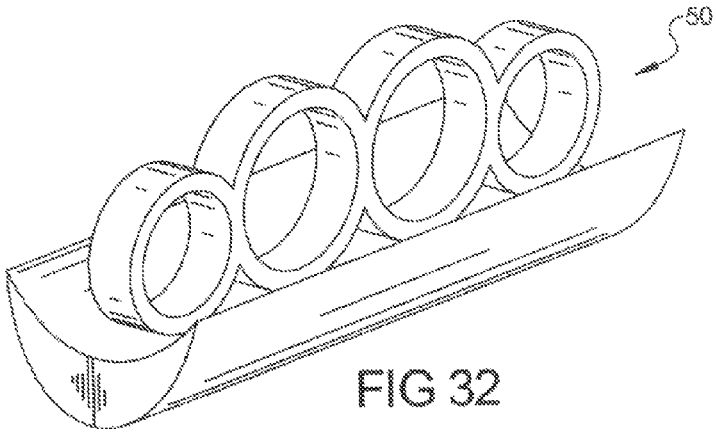
FIG. 32 is a front perspective view of a finger extender tool.
Figure 33:
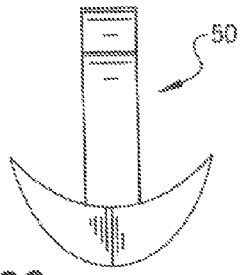
FIG. 33 shows a side view of the FIG. 32 tool.

With reference to FIGS. 32 and 33, there is shown a finger extender tool 50. FIG. 32 shows a front perspective view of the tool 50. FIG. 33 shows a side view of the tool.

Figure 34:
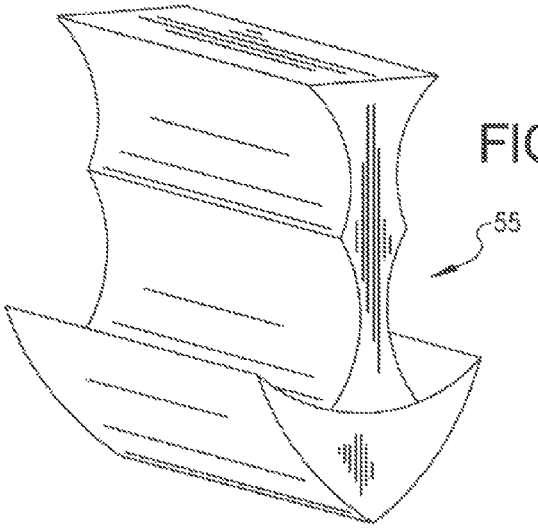
FIG. 34 is a perspective view of a first intrinsic adduction tool.

With reference to FIG. 34, there is an intrinsic adduction tool 55.

Figure 35:
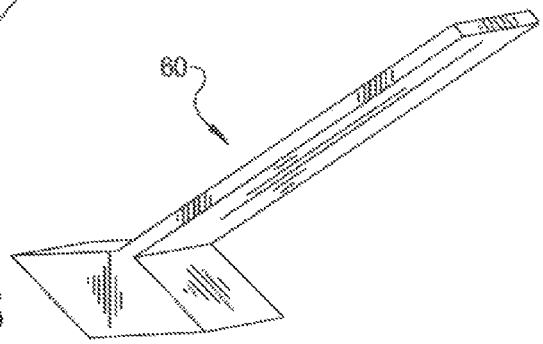
FIG. 35 is a perspective view of a zipper pull tool.

With reference to FIG. 35, there is shown a zipper pull tool 60.

Figure 36:
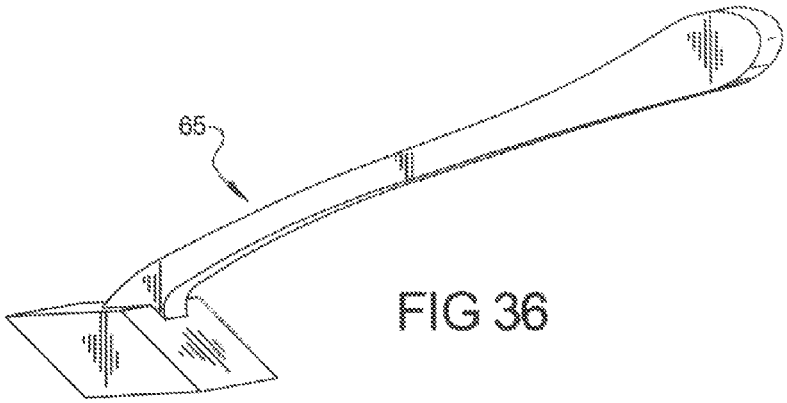
FIG. 36 is a perspective view of an utensil tool.

With reference to FIG. 36, there is shown an utensil tool 65.

Figure 37:
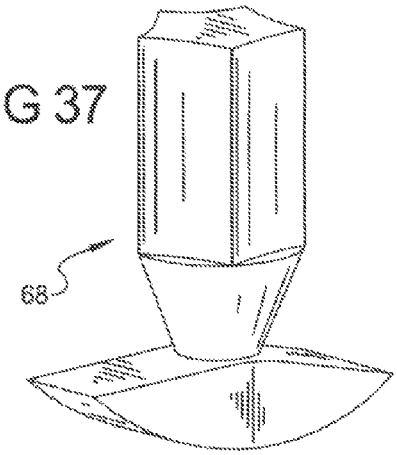
FIG. 37 is a perspective view of an intrinsic turn tool.

With reference to FIG. 37, there is shown an intrinsic turn tool 68.

Figure 38:
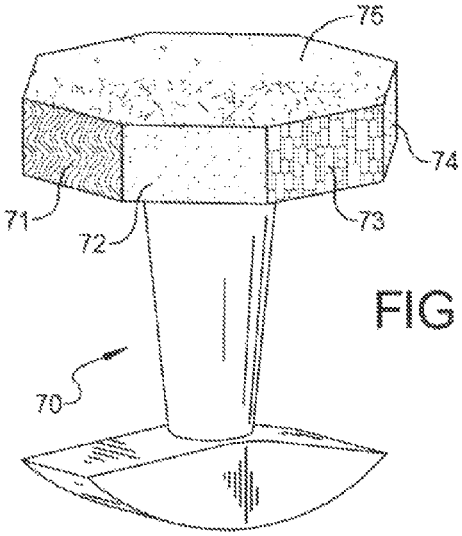
FIG. 38 is a perspective view of a desensitizer tool.

With reference to FIG. 38, there is shown a desensitizer tool 70. The tool 70 has different textures on all is sides 71, 72, 73, 74 and top 75.

Figure 39:
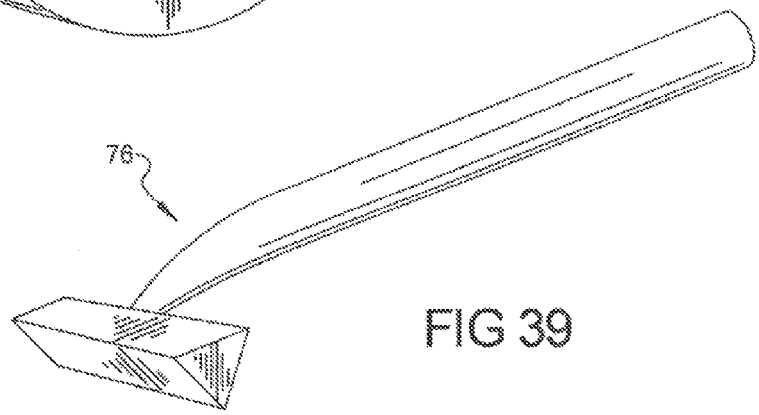
FIG. 39 is a perspective view of a razor tool.

With reference to FIG. 39, there is shown a razor tool 76.

Figure 40:
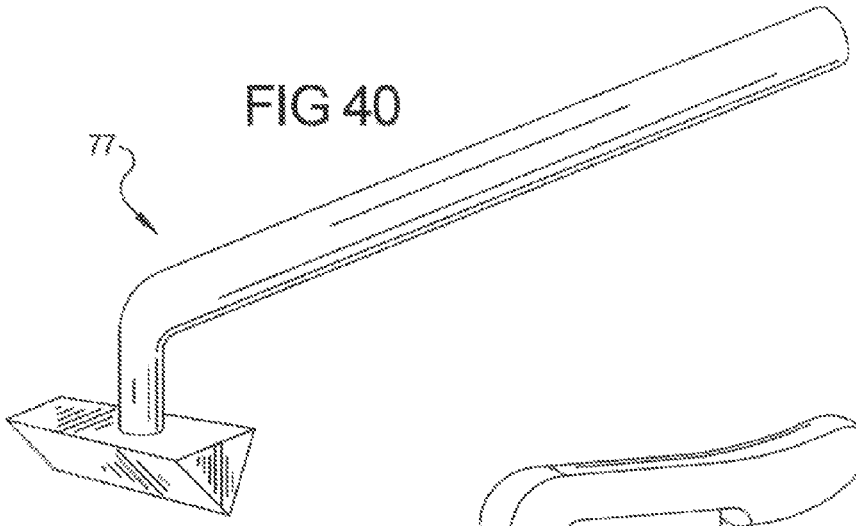
FIG. 40 is a perspective view of a toothbrush tool.

With reference to FIG. 40, there is shown a toothbrush tool 77.

Figure 41:
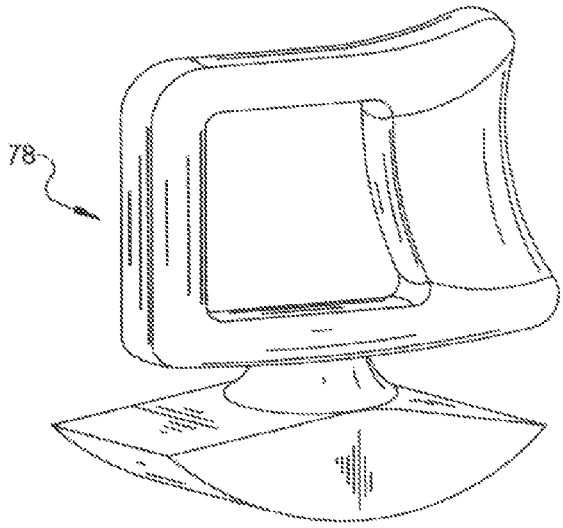
FIG. 41 is a perspective view of a saw handle tool.

With reference to FIG. 41, there is shown a saw handle tool 78.

Figure 42:
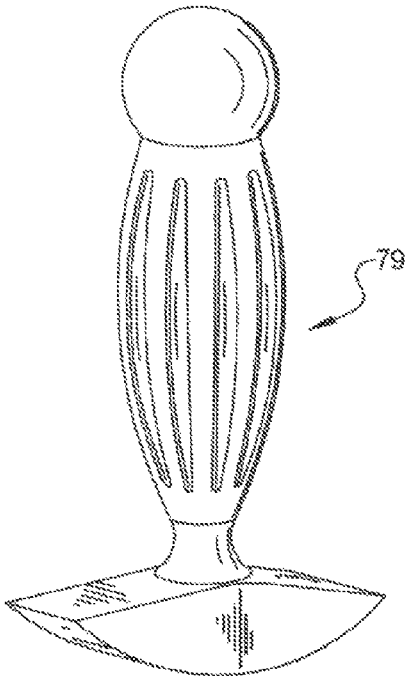
FIG. 42 is a perspective view of a screwdriver tool.

With reference to FIG. 42, there is shown a screwdriver tool 79.

Figure 43:
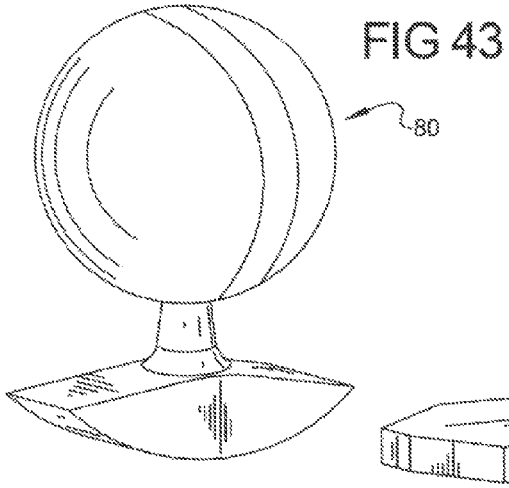
FIG. 43 is a perspective view of a ball tool.

With reference to FIG. 43, a ball tool 80.

Figure 44:
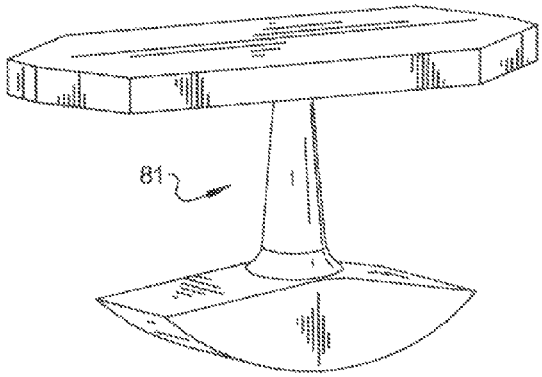
FIG. 44 is a perspective view of a handle tool.

With reference to FIG. 44, there is shown a handle tool 81.

Figure 45:
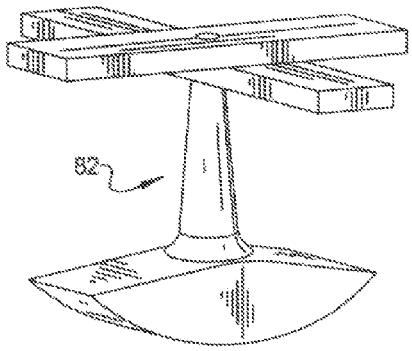
FIG. 45 is a perspective view of a cross-handle turn tool.

With reference to FIG. 45, there is a cross-handle turn tool 82.

With reference to FIG. 46, there is shown a cap turn tool 83. Use of the tool 83 simulates several functions, such as, for example, opening/closing a water bottle, turning on a stove, tightening a large bolt, etc. The tool 83 can be used with various joint protection techniques, such as, for example, using a "C" grasp when opening a water bottle to avoid ulnar stress to MP joints and loading to the CMC joint. In conjunction with the putty, the tool 83 can be used for standard turn, tip turn, "C" grip, FPL push, FPL turn, intrinsic turn, etc.

With reference to FIG. 47, there is shown a key turn tool 84. Use of the tool 84 simulates several functions, such as, for example, turning a key, holding onto a paper folder, throwing a Frisbee, holding a clothespin open, pinching your spouse, etc. The tool 84 can also be used with various joint protection techniques, such as, for example, using intrinsic hold with thin objects instead of a lateral pinch to decrease repetitive stress the CMC joint and ulnar deviation to the MP joints, etc. In conjunction with the putty, the tool 84 can be used for standard turn, lateral pinch turn, intrinsic plus push, intrinsic turn, lateral pinch pull, and intrinsic pull.

With reference to FIG. 48, there is shown a knob turn tool 85. Use of the tool 85 simulates several functions, such as, for example, opening a door, tightening a jar, pushing a lid onto a container, tightening a valve, holding a glass of water, opening a makeup container, etc. The tool 85 can also be used with various joint protection techniques, such as, for example, using a "C" grip to avoid ulnar stress to MP joints, using pressure proximal to the thumb IP joint with a grip to decrease loading to the CMC joint, etc.

Figure 49:
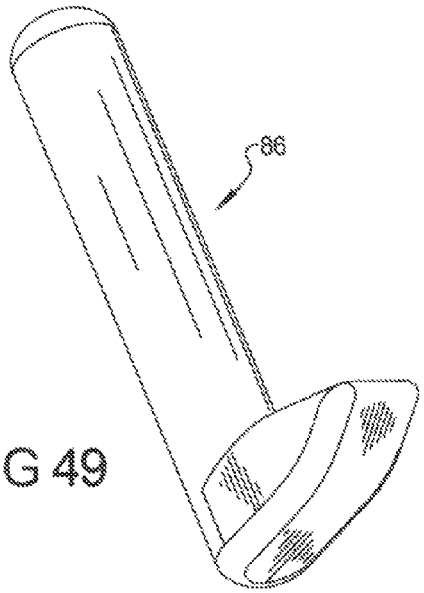
FIG. 49 is a perspective view of a second "L" bar tool.

With reference to FIG. 49, there is shown a second "L" bar tool 86. Use of the tool 86 simulates several functions, such as, for example, pulling a vacuum cleaner, sweeping (functional grip with forearm pronation and supination), using a hammer, operating a throttle on a motorcycle, etc. The tool 86 can also be used with various joint protection techniques, such as, for example, using a neutral hold technique to avoid ulnar stress to MP joints, using the larger joints to produce the movement, etc. In conjunction with the putty, the tool 86 can be used for forearm supination, forearm pronation, radial deviation, ulnar deviation, functional pull, wrist flexion, and wrist extension.

Figure 50:
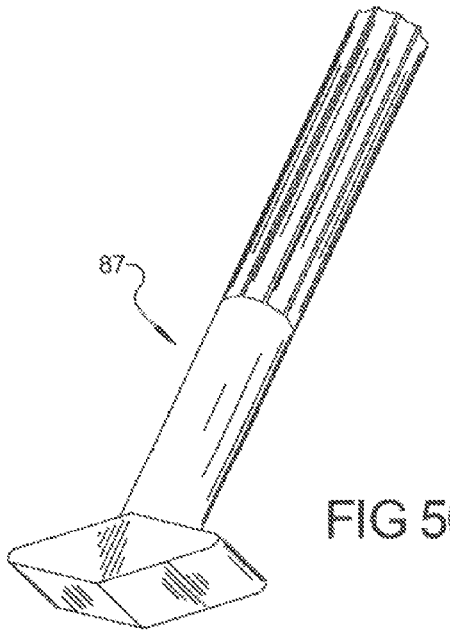
FIG. 50 is a perspective view of a peg turn tool.

With reference to FIG. 50, there is shown a peg turn tool 87. Use of the tool 87 simulates several functions, such as, for example, turning a bolt/nut, pushing a button, picking up a pen, holding a straw, tightening a knob, etc. The tool 87 can also be used with various joint protection techniques, such as, for example, using intrinsic hold to decrease ulnar stress to MP joints, using proximal thumb/webspace to produce hold rather than thumb tip to decrease CMC stress, etc. In conjunction with the putty, the tool 87 can be used for standard turn, tip turn, FPL turn, FPL push, FDP push, FDS push, peg pull, peg pull up, and intrinsic turn.

Figure 51:
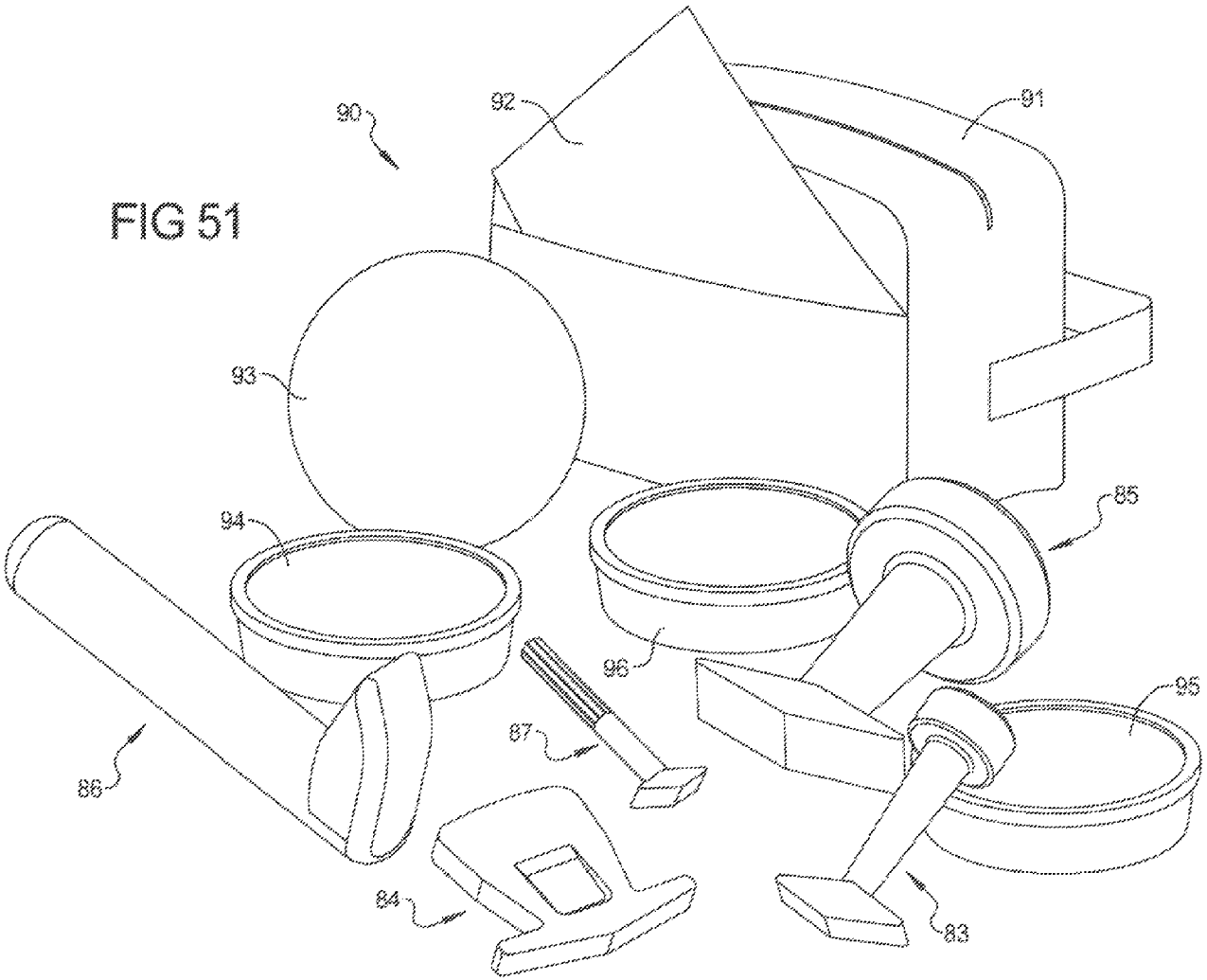
FIG. 51 is a perspective view of a kit of components.

With reference to FIG. 51, there is shown a kit of components 90 according to the invention. The kit 90 may comprise various tools and graded putty. In FIG. 51, the kit 90 comprises the tools 83-87, containers 93-96 of various graded resistance putties of different colors, an exercise/instruction manual 92, which all fit within a carrying case 91.

The putty 14 is provided in various resistances, e.g., soft, medium, medium-hard, hard. The tools used in conjunction with the graded resistance putty 14 enables the patient to progress gradually with the therapy methods and exercise programs in accordance with the invention.

The invention provides a cost-effective, multi-functional group of fine/gross motor exercise equipment/tools and unique methods of using same for clinic use. These can also be purchased by the patient to include into their home exercise program.

There have been illustrated in the accompanying drawings and described hereinabove only several of the unique and novel embodiments of the present invention which can be practiced and constructed in many different configurations, arrangements of components, sizes, shapes, and exercises therewith.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A hand/forearm therapy exercise tool kit of components, comprising, in combination:

a first container having therein a first graded therapeutic exercise putty;

said first graded therapeutic exercise putty having a first color and a first predetermined graded resistance;

a second container having therein a second graded therapeutic exercise putty;

said second graded therapeutic exercise putty having a second color and a second predetermined graded resistance;

said second color being different than said first color;

said second predetermined graded resistance being greater than said first predetermined graded resistance;

a third container having therein a third graded therapeutic exercise putty;

said third graded therapeutic exercise putty having a third color and a third predetermined graded resistance;

said third color being different than said first and second colors;

said third predetermined graded resistance being greater than said second predetermined graded resistance;

a fourth container having therein a fourth graded therapeutic exercise putty;

said fourth graded therapeutic exercise putty having a fourth color and a fourth predetermined graded resistance;

said fourth color being different than said first, second and third colors;

said fourth predetermined graded resistance being greater than said third predetermined graded resistance;

a plurality of hand/forearm therapy exercise tool apparatuses;

each said hand/forearm therapy exercise tool apparatus comprises a one-piece, unitary, integral structure;

each said hand/forearm therapy exercise tool apparatus includes a first predetermined portion unitary and integral with a second predetermined portion;

said first predetermined portion has a first predetermined shape which is configured, fabricated and designed for insertion into said first, second, third or fourth graded therapeutic exercise putty and for movement within said first, second, third or fourth graded therapeutic exercise putty after insertion therein;

said second predetermined portion has a second predetermined shape which is configured, fabricated and designed to be grasped by one or more hands, fingers, fingertips, or between finger digits of a user to enable the user to manipulate the associated hand/forearm therapy exercise tool to cause said first predetermined portion to move in a predetermined trajectory within and relative to the graded therapeutic exercise putty in which it is inserted;

said first predetermined portion in conjunction with the putty in which it is inserted provides a predetermined resistance to said movement in said predetermined trajectory within and relative to the putty;

an exercise instruction manual;

said plurality of hand/forearm therapy exercise tool apparatuses in conjunction with said first, second, third and fourth graded therapeutic exercise putties enables the user to progress gradually with therapy methods and exercise programs in accordance with said exercise instruction manual; and a carrying case in which said first, second, third and fourth containers, said plurality of hand/forearm therapy exercise tool apparatuses, and said exercise instruction manual fit.

2. A hand/forearm therapy exercise tool kit of components according to claim 1, wherein:

said plurality of hand/forearm therapy exercise tool apparatuses includes at least one hand/forearm therapy exercise tool apparatus selected from a group consisting of a pro/sup wheel tool apparatus, a digit extension loop tool apparatus, an intrinsic adduction tool apparatus, a desensitizer tool apparatus, a saw handle tool apparatus, a crank turn tool apparatus, a finger extender tool apparatus, an intrinsic turn tool apparatus, and a cross-handle turn tool apparatus.

3. A hand/forearm therapy exercise tool kit of components according to claim 1, wherein:

said plurality of hand/forearm therapy exercise tool apparatuses includes an "L" bar tool apparatus.

4. A hand/forearm therapy exercise tool kit of components according to claim 1, wherein:

said plurality of hand/forearm therapy exercise tool apparatuses includes a "T" bar tool apparatus.

5. A hand/forearm therapy exercise tool kit of components according to claim 1, wherein:

said plurality of hand/forearm therapy exercise tool apparatuses includes a plank tool apparatus.

6. A hand/forearm therapy exercise tool kit of components according to claim 1, wherein:

said plurality of hand/forearm therapy exercise tool apparatuses includes a zipper pull tool apparatus.

7. A hand/forearm therapy exercise tool kit of components according to claim 1, wherein:

said plurality of hand/forearm therapy exercise tool apparatuses includes a razor tool apparatus.

8. A hand/forearm therapy exercise tool kit of components according to claim 1, wherein:

said plurality of hand/forearm therapy exercise tool apparatuses includes a toothbrush tool apparatus.

9. A hand/forearm therapy exercise tool kit of components according to claim 1, wherein:

said plurality of hand/forearm therapy exercise tool apparatuses includes an utensil tool apparatus.

10. A hand/forearm therapy exercise tool kit of components according to claim 1, wherein:

said plurality of hand/forearm therapy exercise tool apparatuses includes a screwdriver tool apparatus.

11. A hand/forearm therapy exercise tool kit of components according to claim 1, wherein:

said plurality of hand/forearm therapy exercise tool apparatuses includes a ball tool apparatus.

12. A hand/forearm therapy exercise tool kit of components according to claim 1, wherein:

said plurality of hand/forearm therapy exercise tool apparatuses includes a peg turn tool apparatus.

13. A hand/forearm therapy exercise tool kit of components according to claim 1, wherein:

said plurality of hand/forearm therapy exercise tool apparatuses includes a cap turn tool apparatus.

14. A hand/forearm therapy exercise tool kit of components according to claim 1, wherein:

said plurality of hand/forearm therapy exercise tool apparatuses includes a handle tool apparatus.

15. A hand/forearm therapy exercise tool kit of components according to claim 1, wherein:

said plurality of hand/forearm therapy exercise tool apparatuses includes a peg tool apparatus.

16. A hand/forearm therapy exercise tool kit of components according to claim 1, wherein:

said plurality of hand/forearm therapy exercise tool apparatuses includes a bolt turn tool apparatus.

17. A hand/forearm therapy exercise tool kit of components according to claim 1, wherein:

said plurality of hand/forearm therapy exercise tool apparatuses includes a lock key turn tool apparatus.

18. A hand/forearm therapy exercise tool kit of components according to claim 1, wherein:

said plurality of hand/forearm therapy exercise tool apparatuses includes a knob turn tool apparatus.

19. A hand/forearm therapy exercise tool kit of components according to claim 1, wherein:

said plurality of hand/forearm therapy exercise tool apparatuses includes a nut turn tool apparatus.

20. A hand/forearm therapy exercise tool kit of components according to claim 1, wherein:

said plurality of hand/forearm therapy exercise tool apparatuses includes a bottle cap turn tool apparatus.

* * * * *